United States Patent [19]

Mullins et al.

[11] Patent Number: 4,565,154

[45] Date of Patent: Jan. 21, 1986

[54] PROCESS AND APPARATUS FOR APPLYING AND CONFINING FINISH

[75] Inventors: Phillip L. Mullins, Matoaca, Va.; James G. Neal, Raleigh, N.C.; Jeffrey T. Perkins, Richmond, Va.

[73] Assignee: Allied Corporation, Morris Township, Morris County, N.J.

[21] Appl. No.: 749,327

[22] Filed: Jun. 27, 1985

Related U.S. Application Data

[60] Division of Ser. No. 497,530, May 24, 1983, Pat. No. 4,544,579, which is a continuation-in-part of Ser. No. 303,330, Sep. 18, 1981, abandoned.

[51] Int. Cl.[4] ..... B05C 3/00

[52] U.S. Cl. ..... 118/410; 118/325; 118/326; 118/420

[58] Field of Search ..... 118/410, 420, 325, 326, 118/234

[56] References Cited

U.S. PATENT DOCUMENTS

| | | | |
|---|---|---|---|
| 3,323,941 | 6/1967 | Van Dijk | 118/420 |
| 3,382,845 | 5/1968 | Jester | 118/326 |
| 3,422,796 | 1/1969 | Baber | 118/411 |
| 3,679,476 | 7/1972 | Van Oosterhout | 118/410 |
| 4,051,807 | 10/1977 | Graf | 118/410 |
| 4,158,343 | 6/1979 | Nord | 118/326 |
| 4,299,186 | 11/1981 | Pipkin | 118/410 |
| 4,325,322 | 4/1982 | Louch et al. | 118/420 |

*Primary Examiner*—Richard Bueker
*Attorney, Agent, or Firm*—William H. Thrower

[57] ABSTRACT

Process and apparatus for applying finish to yarn and confining finish are disclosed. The apparatus for applying finish features an applicator face which comprises the delivery area of a finish supply duct and the surface area of two primary arcs, one located on either side of the duct and curving in the general direction of yarn travel. The central angle subtended by each of the primary arcs ranges from about 2 to 9 degrees. The edge of each of the primary arcs remote from the duct terminates in a secondary arc which subtends a central angle of 30 to 60 degrees and with a radius length shorter than that of either primary arc. The apparatus for confining finish comprises a housing, plate and baffle(s). The housing substantially encloses a finish application device and has openings for yarn entrance and exit and for take-off of excess finish. The plate is mounted beneath the finish application device. The baffle(s) are disposed between the plate and the take-off opening. The plate and baffle(s) are oriented with respect to the housing such that any finish overflow and spray coming into contact therewith feed by gravity away from the traveling yarn to the take-off opening. The process comprises metering finish to an applicator face and simultaneously maintaining yarn in traveling contact with the entire length of the face and a portion of the edge thereof so that initial and last yarn-to-applicator contact is non-tangential to the applicator face.

18 Claims, 11 Drawing Figures

PROCESS AND APPARATUS FOR APPLYING AND CONFINING FINISH

This application is a division, of application Ser. No. 497,530, filed May 24, 1983, now U.S. Pat. No. 4,544,579, which is a continuation-in-part of application Ser. No. 303,330, filed Sept. 18, 1981, now abandoned.

BACKGROUND OF THE INVENTION

1. Field of the Invention

The present invention relates to application of finish to a traveling yarn and confinement of excess finish for take-off, especially during the separate or combined steps of spin-drawing of one or more ends of multifilament, continuous filament synthetic fiber.

2. The Prior Art

The function of a finish application device is to apply finish at an even rate to a traveling yarn so that the filaments of the yarn are evenly coated with the finish. Many different finish application devices are known, for example, a yarn-contacting roll which is partially submerged and rotating in a bath of finish (lube roll) and yarn-contacting guides or passageways to which finish is metered.

At relatively high processing speeds, on the order of 1500 to 3800 meters per minute, finish application uniformity and efficiency are lower than desired, and the higher incidence at these speeds of thrown-off finish is a housekeeping problem. The present invention has been developed to overcome these problems.

The closest prior art is believed to be U.S. Pat. Nos. 3,244,142 to Walker, 3,422,796 to Baber, 3,754,530 to Pierce, 3,988,086 to Marshall et al., 4,051,807 to Graf et al., 4,255,472 to Williams, Jr., and 4,255,473 to Williams, Jr.

SUMMARY OF THE INVENTION

The present invention provides a process and apparatus for applying finish to yarn and for confining finish.

The apparatus for applying finish to yarn comprises an applicator body, provided with a duct which supplies finish to an applicator face. The face comprises the delivery area of the duct and the surface area of two primary arcs, one of the primary arcs being located on either side of the duct and curving in the general direction of yarn travel. The central angle subtended by each of the primary arcs is about 2 to 9 degrees. The edge of each of the primary arcs remote from the duct terminates in a secondary arc which subtends a central angle of about 30 to 60 degrees, most preferably 45 degrees, and which has a radius length shorter than that of either of the primary arcs and curves in the direction of yarn travel. It is preferred that the radius length of each of the primary arcs be from 0.25 to 4.0 inches (0.64 to 10.2 cm) and that the radius length of each of the secondary arcs be from 0.005 to 0.025 inch (0.01 to 0.06 cm). It is also preferred that the applicator body comprise at least two opposing members, a primary and secondary arc on each member, spaced apart with a spacer which forms a portion of the finish supply duct. The ratio of the length of the duct delivery area to the entire length of the face preferably ranges from 0.10 to 1 to 0.75 to 1, most preferably 0.50 to 1. The most preferred embodiment contemplates the entire applicator face, i.e., the delivery area of the duct and the surface area of the two primary arcs, substantially describing a single arc which subtends a central angle ranging from about 10 to 18 degrees. The radius length of the single arc is preferably about 0.25 to 4.0 inches (0.64 to 10.2 cm).

The present invention also provides apparatus for confining a spray of finish issuing from a traveling yarn and a finish application device during and subsequent to application of the finish. The apparatus comprises a housing, a plate, and at least one baffle. The housing substantially encloses the finish application device and has openings therein for the yarn entrance and exit and for the take-off of excess finish. The plate is mounted beneath the finish application device and oriented with respect to the housing such that any finish overflow and drips from the finish application device coming into contact therewith feed by gravity away from the traveling yarn to the take-off opening. At least one baffle, preferably two, is disposed between the plate and the take-off opening and oriented with respect to the housing such that any finish overflow and spray coming into contact therewith feed by gravity away from the traveling yarn to the take-off opening. The baffle(s) has a slot therein for passage of the yarn and a raised lip around the slot. It is preferred that the apparatus further comprise a gutter disposed between the plate and the baffle and located on the side of the traveling yarn remote from the take-off opening. The gutter is oriented with respect to the housing such that any finish overflow and spray coming into contact therewith feed by gravity away from the traveling yarn to the baffle therebelow. It is especially preferred that a second gutter be disposed between the preferred two baffles.

It is preferred that the previously described finish application device and finish confining apparatus be used in conjunction with one another.

The present invention also provides a process for applying finish to a traveling yarn. The process comprises the steps of:

a. metering a finish through a duct to an applicator face, the face comprising the delivery area of the duct and the surface area of two primary arcs, one of the primary arcs being located on either side of the duct and curving in the general direction of yarn travel, the central angle subtended by each of the primary arcs being about 2 to 9 degrees, the edge of each of the primary arcs remote from the duct terminating in a secondary arc which subtends a central angle of about 30 to 60 degrees and which has a radius length shorter than that of either of the primary arcs and curves in the direction of yarn travel; and b. simultaneously maintaining the yarn in traveling contact with the entire length of the face and the secondary arcs so that the initial and last contact of the yarn with the applicator is non-tangential to the applicator face. Yarn which is traveling at a speed of 1500 to 3800 meters per minute while being maintained in contact with the applicator has finish evenly and efficiently applied thereto. It is preferred that the yarn be maintained out of contact with any device for a distance of one meter subsequent to the last contact of the yarn with the applicator. It is further preferred that the process include the step of confining any spray of finish issuing from the traveling yarn and applicator by means of substantially enclosing the applicator with a housing having openings therein for the yarn entrance and exit and for the take-off of excess finish, feeding any finish overflow, spray and drips by gravity away from the traveling yarn to the take-off opening, and taking off the accumulated finish.

DETAILED DESCRIPTION OF THE DRAWINGS

Figure 1:
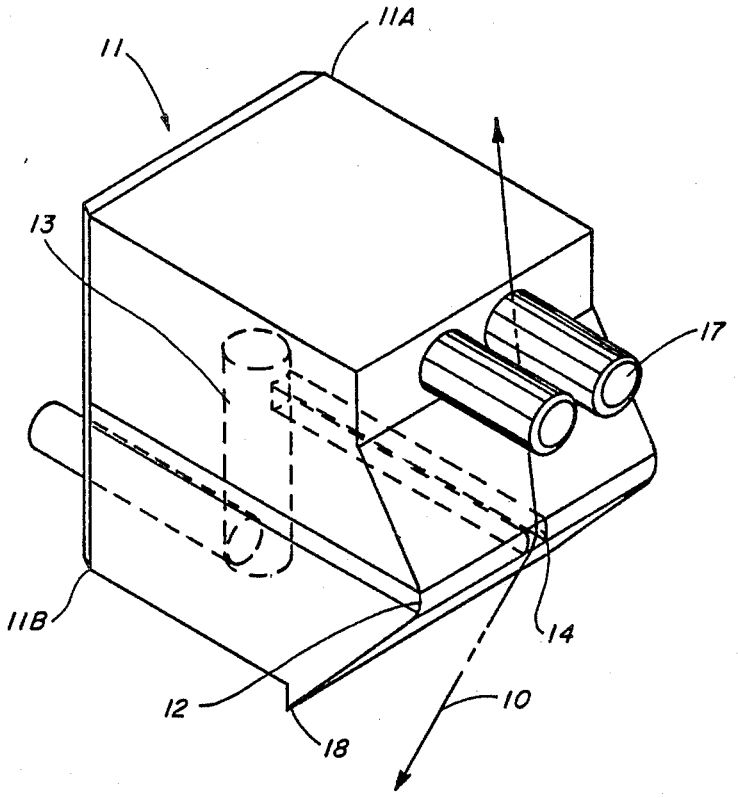
FIG. 1 is an isometric view of the applicator of the present invention.
Figure 1A:
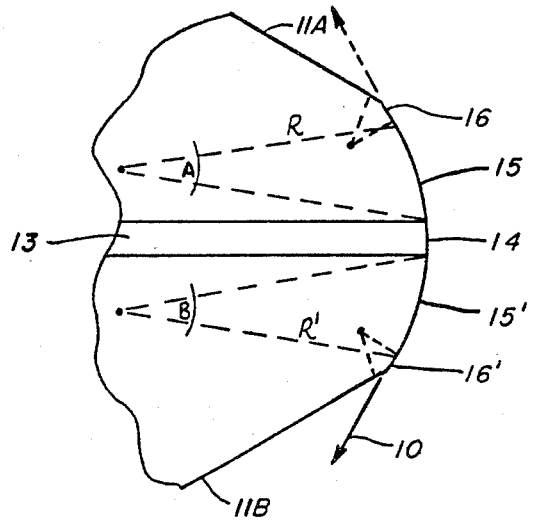
FIG. 1A is a cross-sectional view taken through the applicator center in the vertical plane of the duct delivery area and surrounding portion of the applicator.
Figure 1B:
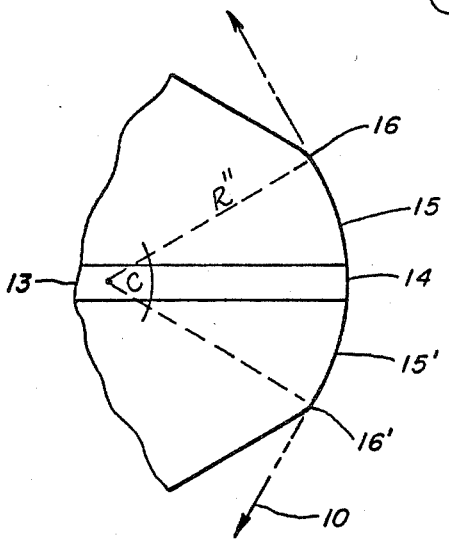
FIG. 1B is a view similar to FIG. 1A of an alternate embodiment.

In the accompanying drawings, like numbers indicate like apparatus. With reference to FIGS. 1, 1A, 1B, 1C and 1D, the applicator of the present invention comprises an applicator body 11 provided with duct 13 which supplies finish to an applicator face. The applicator face comprises delivery area 14 of duct 13 and the surface area of primary arcs 15 and 15'. Primary arcs 15 and 15' are located on either side of the duct and curve in the general direction of yarn 10 travel. The central angles A and B subtended by, respectively, primary arcs 15 and 15' are each about 2 to 9 degrees, preferably 7 degrees each, and most preferably are identical in size. The edges of primary arcs 15 and 15' remote from duct 13 terminate in, respectively, secondary arcs 16 and 16' which subtend, respectively, central angles E and F of about 30 to 60 degrees, preferably 45 degrees. Secondary arcs 16 and 16' also curve in the general direction of yarn 10 travel, and have a surface roughness of about 16 RMS. Radius lengths R and R' of, respectively, primary arcs 15 and 15' are from 0.25 to 4.0 inches (0.64 to 10.2 cm); radius lengths R and R' preferably are equal in length, specifically 0.5 inch (1.25 cm). Radius lengths r and r' of, respectively, secondary arcs 16 and 16' are from 0.005 to 0.025 inch (0.01 to 0.06 cm); radius lengths r and r' preferably are equal in length, specifically 0.016 inch (0.040 cm). With reference to FIG. 1B, it is most preferred that the entire applicator face, i.e., the delivery area 14 of duct 13 and the surface area of primary arcs 15 and 15', substantially describe a single arc which subtends a central angle C ranging from about 10 to 18 degrees, and that radius length R" be about 0.25 to 4.0 inches (0.64 to 10.2 cm), more preferably 0.5 inch (1.25 cm). The applicator body 11 depicted comprises at least 2 opposing members 11A and 11B, a primary 15 and a secondary 16 arc on member 11A and a primary 15' and secondary 16' arc on member 11B, spaced apart with a spacer or gasket 12 which forms a portion of the finish supply duct 13. The ratio of the length of the duct delivery area 14 to the entire length of the face preferably ranges from 0.10 to 1 to 0.75 to 1, most preferably 0.50 to 1. The length of duct delivery area 14 preferably is from 0.031 to 0.125 inch (0.0792 to 0.3175 cm), most preferably 0.063 inch (0.159 cm) in the direction of yarn travel, and the width of duct delivery area 14 is preferably from 0.125 to 0.375 inch (0.318 to 0.953 cm), most preferably 0.125 inch (0.318 cm). In this embodiment, the length of duct delivery area 14 corresponds to the thickness of spacer 12 which may be readily replaced with another gasket or spacer 12 to adapt the duct delivery area 14 length and width as required. The length of primary arcs 15 and 15' may be 0.01 to 0.06 inch (0.025 to 0.152 cm), and most preferably are equal at 0.031 inch (0.079 cm). Finish is supplied via duct 13 and contacts yarn 10 at duct delivery area 14. Yarn 10, during production, contacts the applicator first at secondary arc 16, then primary arc 15 and across duct delivery area 14 to primary arc 15' and secondary arc 16'. Initial and last contact of yarn 10 with the applicator is and must be non-tangential to the applicator face. With reference to FIG. 1, guide pins 17 help to locate yarn 10 for passage across the applicator face. The individual filaments of yarn 10 are relatively spread out, i.e., with only a few rows of filaments on top of one another, on the order of 4 to 8, as yarn 10 passes across the applicator face.

Figure 2:
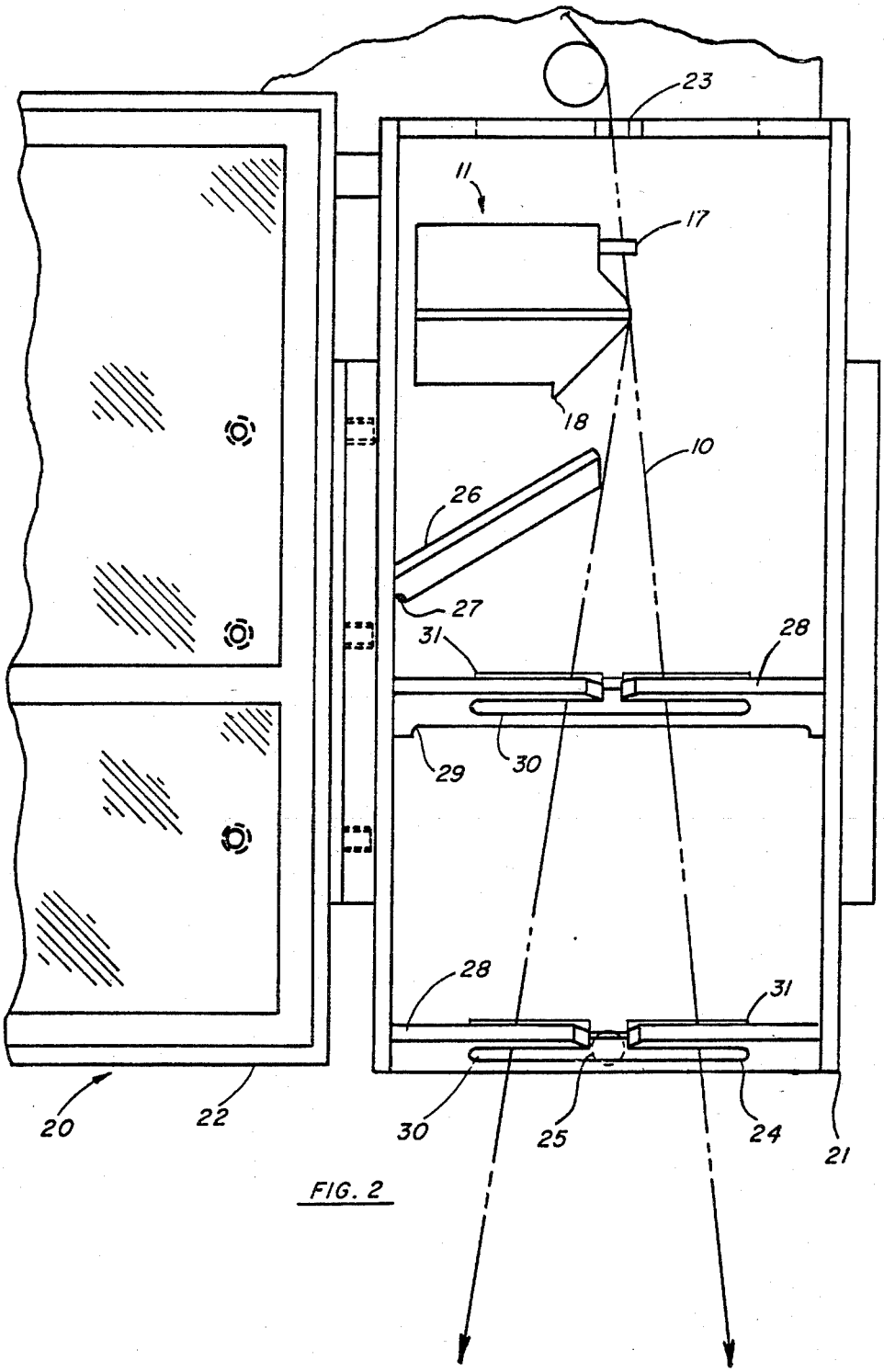
FIG. 2 is a front elevation of the finish confining apparatus of the present invention in the open position.
Figure 3:
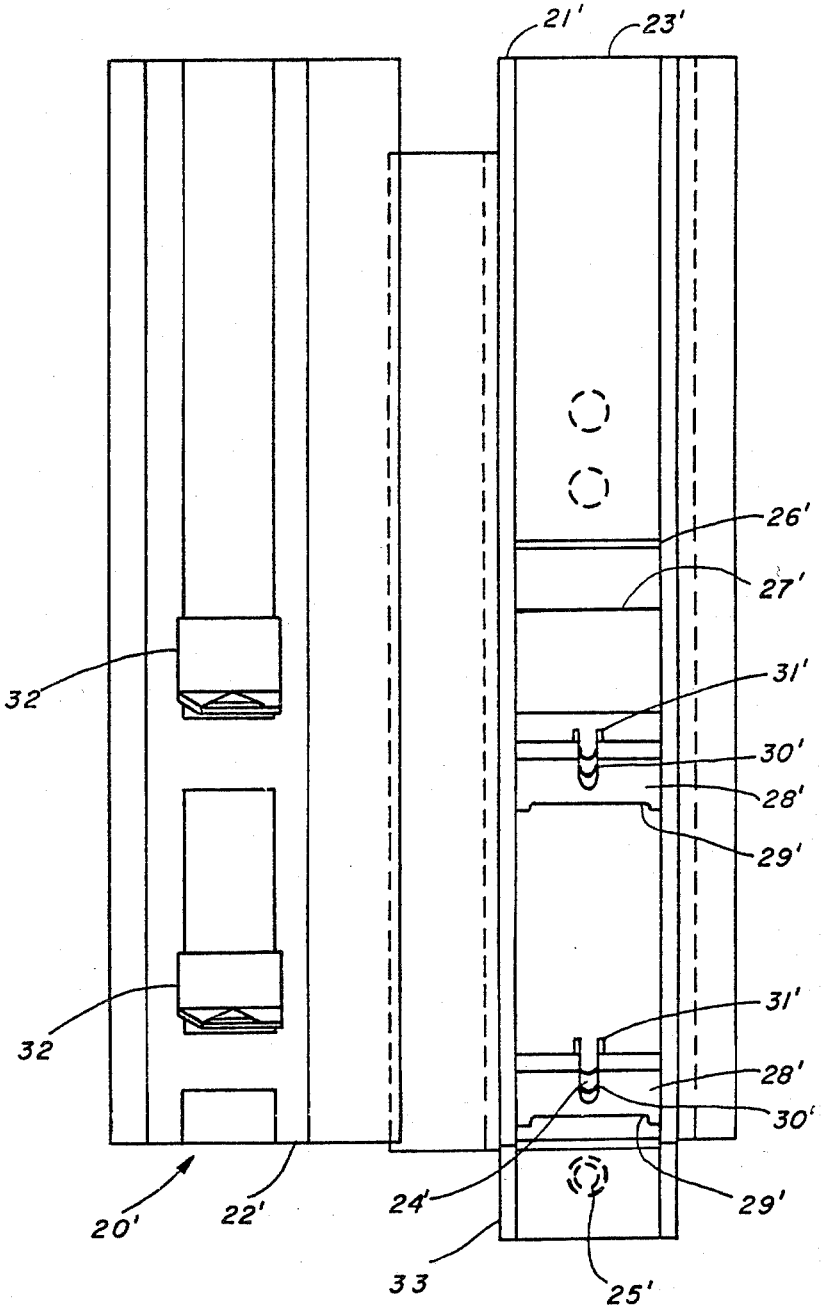
FIG. 3 is a view similar to FIG. 2 of an alternate embodiment.

FIGS. 2 and 3 depict alternate embodiments of enclosures 20, 20', or apparatus for confining a spray of finish issuing from a traveling yarn 10 and a finish application device during and subsequent to application of the finish. Enclosure 20 of FIG. 2 comprises a housing shown as housing body 21 with door 22 in the open position. Housing body 21 and door 22 are depicted as hinged for movement relative to one another with a latch for closure; these two parts, however, may slide relative to one another or be of unitary construction. The latching mechanism is similarly deemed not crucial to operation and may be, for example, a quarter turn latch. When closed, enclosure 20 substantially encloses finish applicator body 11. Enclosure 20 is provided with openings 23, 24 and 25 for, respectively, yarn 10's entrance and exit and for take-off of excess finish. Plate 26 is mounted beneath finish application device 11 and oriented with respect to enclosure 20, i.e., at a 60 degree angle out from the side wall of housing body 21, such that any finish overflow and spray coming into contact therewith feeds by gravity away from the traveling yarn 10 to take-off opening 25, as will be fully explained below. With reference to FIGS. 1 and 2, note that the finish application device has been designed so the surface of body member 11B beneath secondary arc 16' breaks away at a 135 degree angle from the horizontal and abruptly terminates in edge 18. Any overflow at finish duct delivery area 14 will feed by gravity across primary arc 15', secondary arc 16', the straight portion of body member 11B to edge 18 where it will drip to plate 26. At least one baffle 28, preferably two, is disposed between plate 26 and take-off opening 25 and oriented with respect to housing body 21, i.e., at a 20 degree angle with the back wall, such that any finish overflow and spray coming into contact therewith feed by gravity away from the traveling yarn 10 to take-off opening 25, as will be detailed later. In FIG. 2, the lower baffle 28 forms the base of housing body 21, and is beneath take-off opening 25. Each of baffles 28 has a slot 30 therein for string-up and passage of yarn 10. In FIG. 2, slot 30 of lower baffle 28 also forms opening 24 for yarn exit from housing 20. Plate 26 is partially cutaway next to housing body 21 to create a drainage opening 27 through which any finish feeding by gravity down plate 26 will drip to baffle 28. Baffle 28 has a drainage opening 29 cut into the lowermost portion thereof next to the side of housing body 21 for finish to feed by gravity down to the next baffle 28, which is the base of housing body 21 in FIG. 2. Finish will feed by gravity from the base of the enclosure to take-off opening 25 for disposal or recycling. Raised lip 31 around slot 30 prevents finish (feeding by gravity down baffle 28) from coming into contact with traveling yarn 10. Slots 30 in FIG. 2 are made wider than those of FIG. 3 to accommodate the lashing of yarn 10 during take-up, as required by some winders. With reference to FIG. 3, apparatus similar to that of FIG. 2 is indicated by like numbers with a prime. In FIG. 3, the finish application device is opposite door 22' when door 22' is closed. As a consequence, plate 26' is mounted therebelow at an angle of 45 degrees with respect to the back wall of housing body 21'. Plate 26' is spaced from the back wall of housing body 21' to form drainage opening 27'. In FIG. 3, beneath the second baffle 28', is provided another angled plate 33 for receiving any finish flowing through drainage opening 29' of the lowermost baffle 28', for take-off through take-off opening 25'. In addition, housing 20' of FIG. 3 also comprises a gutter 32, one per baffle 28'. When housing 20' is in the closed position, one gutter 32 is disposed between plate 26' and baffle 28', all other gutters 32 being disposed between two of baffles 28', and located on the side of the traveling yarn 10 remote from take-off opening 25'. Gutters 32 are oriented with respect to housing 20' such that any finish overflow and spray coming into contact therewith feed by gravity away from traveling yarn 10 to baffle 28' therebelow. In FIG. 3, gutters 32 are depicted as angles with a triangular wedge mounted to the lower leg for the purpose of channeling any finish coming into contact therewith around traveling yarn 10 onto baffle 28' next therebelow. Gutters 32 are shown mounted to door 22'.

EXAMPLES 1–6

A melt of polyethylene terephthalate was supplied at a rate of 40 pounds (18.2 kg) per hour per end and at a temperature of about 280° C. to the apparatus shown in FIGS. 1 and 2 of U.S. Pat. No. 4,251,481 to Hamlyn, hereby incorporated by reference. The molten polymer was fed by extruder 11 to spin pump 12 which fed spin block 13 containing a conventional spin pot as shown in FIG. 1 of U.S. Pat. No. 4,072,457 to Cooksey et al., hereby incorporated by reference. A split spinnerette designed for the simultaneous extrusion of two multifilament ends of 192 filaments each was utilized, the spinnerette orifices having a diameter of about 0.02 inch (0.05 cm) and being spaced so that the distance between the filaments formed per end was about 0.28 to 0.40 inch (0.71 to 1.0 cm) immediately below the spinnerette.

Figure 1C:
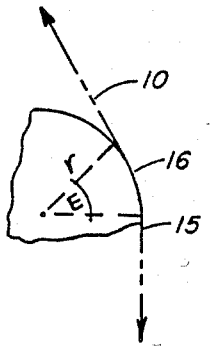
FIGS 1C and 1D are greatly magnified cross-sectional views taken through the center of the applicator in the vertical plane of, respectively, secondary arcs 16 and 16'.
Figure 1D:
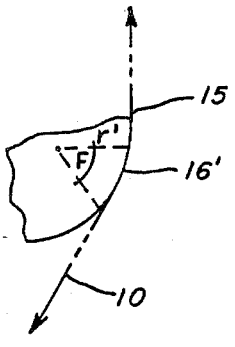

The two ends 14 and 15 of multifilament, continuous filament yarn passed downwardly from the spinnerette into a substantially stationary column of air contained in a heated sleeve 16, about 15 inches (38.1 cms) in height, the temperature of the sleeve itself being maintained at about 275° C. Yarn leaving heated sleeve 16 was passed directly into the top of the quench chamber of quenching apparatus 17. Quenching apparatus 17 was as shown in FIG. 1C of U.S. Pat. No. 3,999,910 to Pendlebury et al., hereby incorporated by reference. Quenching air at about 18.3° C. (65° F.) and 60 percent relative humidity was supplied to cross flow quench the filaments as they descended through the quench chamber. The ends 14 and 15 of yarn were lubricated by finish applicator 18 and then separated and converged by guides 19. The spin finish applied comprised 40 parts mineral oil having a viscosity of 38–40 SUS and a boiling range between 266° and 327° C.; 15 parts refined coconut oil; 15 parts isohexadecyl stearate; 5 parts ethoxylated alkylamine; 13 parts ethoxylated lauryl ether; 10 parts sodium salt of alkylarylsulfonate; 2 parts of a solution of 75 weight percent sodium dinonyl sulfosuccinate, 10 weight percent isopropanol and 15 weight percent water. A sufficient amount of the finish composition was applied to the yarn to attain about 0.2 percent, based on the weight of the drawn yarn, on the yarn. The ends were then transported via interfloor tube and aspirator 20 to the spin draw panel 21 where they were fed to wrap around a pretension roll 23 and accompanying separator roll 23*a* and then to feed roll 24 and accompanying separator roll 24*a* rotating at a speed of about 918 revolutions per minute. Both sets of rolls were at a temperature of less than 50° C. From feed roll 24, the ends were then passed through conventional steam impinging draw point localizing jet 25, supplying steam at a temperature of 500° C. and at a pressure of 70 psig (483 kPa), and then to a pair of draw rolls 26 and 26*a*, rotating at 5643 revolutions per minute, and maintained at about 190° C. The draw ratio was about 6.2 to 1. The ends passed from draw roll 26 to a pair of relax rolls 27 and 27*a*, the relax rolls 27 and 27*a* being heated to 170° C. and rotating at 5500 revolutions per minute. The yarn ends then passed through a conventional air operated interlacing jet 28. In Examples 1–3, the low viscosity (0.75 yarn intrinsic viscosity) yarn ends were then fed separately to apparatus as shown in FIG. 1 of the present invention for application of an aqueous overfinish containing 30 weight percent of an oil phase comprising 65 parts isohexadecyl stearate; 6 parts glycerol monooleate; 5 parts decaglycerol tetraoleate; 8 parts POE(15) tall oil fatty acid; 12 parts sulfonated glycerol trioleate; and 4 parts POE(20) tallow amine. The total oil on yarn was targeted for 0.8 percent, with 0.6 percent add on. Thereafter, the yarn ends were taken up by a winder 22 at a tension of about 0.35 gram per denier and at a speed of 2750 m/min.

The finish applicator device was as depicted in FIGS. 1, 1B, 1C and 1D. The central angle C of FIG. 1B was 14 degrees, and radius length R" was 0.5 inch (1.25 cm). Duct delivery area 14 had a length and width of, respectively, 0.063 inch (0.159 cm) and 0.125 inch (0.318 cm). The lengths of primary arcs 15 and 15' were equal at 0.031 inch (0.079 cm) to give a ratio of the length of duct delivery area 14 to the entire length of the face of 0.50 to 1. Central angles E and F (FIGS. 1C and 1D) of, respectively, secondary arcs 16 and 16' were 45 degrees, and radius lengths r and r' were equal at 0.016 inch (0.040 cm). The finish delivery rate, specified in Table 1, was per end, based on weight of the yarn.

Figure 4:
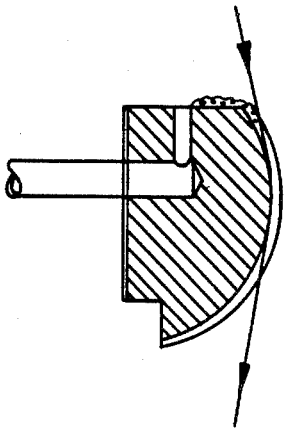
FIG. 4 (PRIOR ART)
FIG. 4 is a sectional view of a prior art applicator wherein finish is metered for gravity flow down the curved surface contacting the traveling yarn—initial and last yarn contact is tangential to the surface.

In Examples 4–6, the applicator device was as depicted in FIG. 4, i.e., a curved surface with tangential yarn contact and over which the finish flows by gravity.

The effectiveness of the applicator devices was measured in accordance with the following procedure.

PROCEDURE

1. Weigh about 10 grams of sample yarn to the nearest tenth of a mg and place in a Soxhlet extraction tube, 40 mm size.

2. Add 125 ml of cyclohexane into a tared 250 ml 24/40 joint Erlenmeyer flask.

3. Assemble the boiling flask. Soxhlet tube containing the sample, and an Allihn type condenser with bulbs, under a hood.

4. Using a heating mantle or hot plate, increase the temperature of the cyclohexane until refluxing commences (81°–82° C.). Provide a sufficient flow of cold water through the condenser to condense the cyclohexane vapors 5. Allow the cyclohexane to reflux until the yarn sample in the Soxhlet extraction tube is completely covered with hot cyclohexane and the cyclohexane recycles into the 250 ml boiling flask. Allow this process to repeat three more times.

6. Decrease the temperature and remove the condenser from the extraction apparatus.

7. Transfer the yarn in the extraction tube to a funnel and pour the cyclohexane-oil mixture over the yarn and let it drain into the tared 250 ml 24/40 joint Erlenmeyer flask 8. Using a rubber policeman, squeeze the cyclohexane from the yarn allowing it to drain into the tared 250 ml 24/40 joint Erlenmeyer flask also.

9. Rinse the extraction tube with 10 mls cyclohexane and add this to the tared Erlenmeyer flask.

10. Place the tared flask containing the cyclohexane-finish oil mixture onto the hot plate.

11. Increase the temperature until the cyclohexane begins to boil (81°–82° C.) and evaporate to dryness.

12. Using a desiccator, allow the Erlenmeyer flask to cool to room temperature and weigh to the nearest tenth of a mg.

13. Calculate the weight percent finish:

$$\text{Weight \% Finish} = \frac{\text{Wt. of Sample Residue}}{\text{Sample Weight}} \times 110$$

where the weight of the residue is equal to the weight of the flask after evaporation minus the original weight of the flask.

The percent oil added to the yarn is the percent oil on the overfinished yarn less the percent oil on the control, or non-overfinished, yarn. The oil delivered to the applicator face equals the rate finish is delivered X percent of oil in overfinish. The oil pick-up efficiency (percent) is calculated:

$$\text{Oil Pickup Efficiency (\%)} = \frac{\text{Oil Added to Yarn}}{\text{Oil Delivered}} \times 100$$

Results of testing are presented in Table 1. End to end variability was ranked A through E based on a difference in oil add on (%) of: <0.1, 0.1–0.2, 0.2–0.3, 0.3–0.4, and 0.4–0.5, respectively, with A representing least variability and best performance. It can be seen that the applicator of the present invention (Examples 1–3) had much better oil pickup efficiency and was closer to the oil add on target. End to end variability was low.

EXAMPLE 7

The procedure of Example 1 was repeated with the following changes. The apparatus of FIGS. 1 and 3 was used, and a different winder was used. The draw point localizing jet supplied steam at a temperature of 520° C. and at a pressure of 85 psig (586 kPa). The pair of draw rolls was maintained at 200° C. One of the relax rolls was unheated and the other was maintained at 130° C. and rotated at 5530 revolutions per minute. Excellent results were also obtained with this apparatus.

EXAMPLES 8–19

Figure 5:
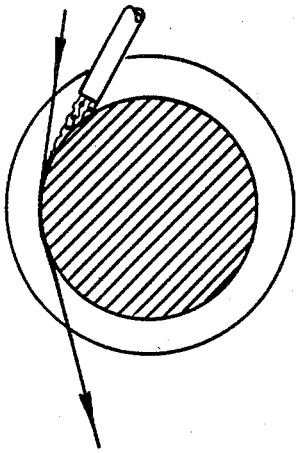
FIG. 5 (PRIOR ART)
FIG. 5 is a sectional view of a prior art applicator wherein finish is metered onto a grooved roll which may be rotating in the direction of yarn travel—initial and last yarn contact is tangential to the lubricating surface.
Figure 6A:
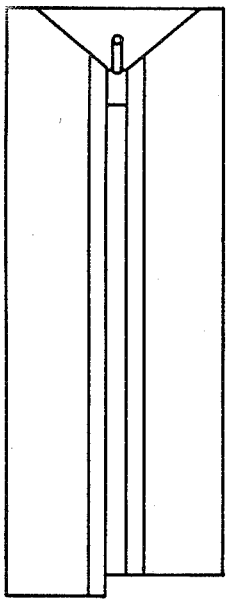
FIG. 6A (PRIOR ART)
FIG. 6A is a side elevation of a prior art applicator similar to that of U.S. Pat. No. 3,754,530 to Pierce, hereby incorporated by reference.
Figure 6B:
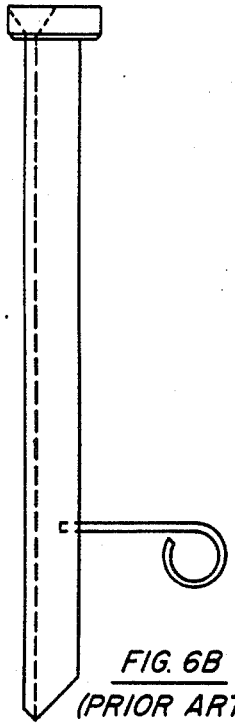
FIG. 6B (PRIOR ART)
FIG. 6B depicts the insert member for the FIG. 6A applicator.

The procedure of Example 1 was repeated with the following changes. In Examples 8–10, the apparatus of FIG. 1 was used. In Examples 11–13, the apparatus of FIG. 4 was used. In Examples 14–17, the apparatus of FIGS. 6A and 6B was used. In Examples 18–19, the apparatus of FIG. 5 was used. Temperature of the heated sleeve was about 350° C. The draw point localizing jet supplied steam at a temperature of 475° C. and at a pressure of 100 psig. The pair of draw rolls was maintained at 130° C. The draw ratio was about 5.9 to 1. One of the relax rolls was unheated and the other was maintained at 140° C. The yarn intrinsic viscosity was 0.88. The yarn ends were taken up at a tension of about 0.10 gram per denier.

Results of testing are presented in Table 2. It can be seen that the applicator of the present invention (Examples 8–10) was superior to the other tested applicators. The performance of the FIG. 4 applicator (Examples 11–13) was comparable in some aspects but inferior with respect to oil pickup efficiency. A grooved lube roll was evaluated at lube roll speeds of greater than 60 RPM; oil pickup efficiency was approximately 40%.

EXAMPLES 20–61

The procedure of Examples 8–19 was repeated in Examples 20–61. In Examples 20–27, apparatus similar to that of FIG. 1 but without secondary arcs (initial and last yarn contact tangential) was tested. In Examples 28–39, apparatus similar to that of Examples 20–27 was utilized but with the bottom member of the applicator protruding 0.041 cm (0.016 inch) from the top member at the slot (initial and last yarn contact tangential). Widths and lengths for the slots of Examples 28–31, 32–35 and 36–39 were, respectively, 0.236 cm by 0.081 cm (0.093 inch by 0.032 inch), 0.318 cm by 0.157 cm (0.125 inch by 0.062 inch), and 0.157 cm by 0.038 cm (0.062 inch by 0.015 inch). In Examples 40–43 a grooved lube roll having a 5.40 cm (2.13 inch) diameter with 0.236 cm (0.093 inch) wide groove 0.236 cm (0.093 inch) deep and rotating in the direction of yarn travel was utilized. In Examples 44–45, the grooved lube roll of Examples 40–43 was utilized with the roll rotating opposite to the direction of yarn travel. In Examples 46–61, overfinish was metered onto the groove of a grooved lube roll (as in FIG. 5). Results are presented in Table 3.

A comparison of Examples 20–27 of the prior art with Examples 8–10 (Table 2) of the present invention shows the dramatic improvement in oil pickup efficiency achieved by including secondary arcs on the applicator face to cause initial and last yarn contact with the applicator to be non-tangential to the applicator face. Note that the excellent efficiencies of Examples 23 and 24 are at unacceptably low oil metering levels.

In Examples 28–39, it is believed that the finish metering pump may have been set at an incorrect speed; the erratic oil on yarn data for Examples 29, 30 and 39 are believed to be due to either recording errors or insufficient finish pump pumping. With the exception of Example 31, the end to end variability was very poor when oil pickup efficiency was high, and oil pickup efficiency was very poor when end to end variability was good.

With respect to Examples 40–45, oil pickup efficiency was low. At increased roll speeds, the oil was slung from the roll and created housekeeping problems.

In Examples 46–61, the applicator metered finish outside the groove. Good oil pickup efficiencies and end to end variability were obtained at the low oil metering levels; at the more acceptable metering levels, however, of Examples 54–61, the oil pickup efficiency was too low. In these examples the metering device was improperly designed; the design was corrected and tested in Examples 18–19 where the maximum efficiency achieved was 74.4% (Example 19), more successful than in Examples 46–61 but less efficient than obtained with the applicator of the present invention.

TABLE 1

COMPARISON OF APPLICATORS

| | Example | | | | | |
|---|---|---|---|---|---|---|
| | 1 | 2 | 3 | 4 | 5 | 6 |
| Applicator** | 1 | 1 | 1 | 4 | 4 | 4 |
| Oil Metered, % | 0.379 | 0.526 | 0.692 | 0.398 | 0.549 | 0.694 |
| Oil on Yarn, % | | | | | | |
| Front | 0.675 | 0.825 | 0.850 | 0.520 | 0.630 | 0.675 |
| Rear | 0.660 | 0.785 | 0.895 | 0.465 | 0.740 | 0.620 |
| Oil Add On, % | | | | | | |
| Front | 0.330 | 0.480 | 0.505 | 0.175 | 0.285 | 0.330 |
| Rear | 0.360 | 0.485 | 0.595 | 0.165 | 0.440 | 0.320 |
| Oil Pick Up Efficiency, % | | | | | | |
| Front | 86.8 | 91.0 | 72.8 | 43.8 | 51.8 | 47.4 |
| Rear | 95.0 | 92.4 | 86.2 | 41.6 | 80.2 | 46.2 |
| Average | 90.9 | 91.7 | 79.5 | 42.7 | 66.0 | 46.8 |
| End to End Variability | A | A | A | A | B | A |

**Numbers correspond to drawing figures.

TABLE 2

COMPARISON OF APPLICATORS

| | Example | | | | | | | | | | | |
|---|---|---|---|---|---|---|---|---|---|---|---|---|
| | 8 | 9 | 10 | 11 | 12 | 13 | 14* | 15* | 16* | 17* | 18 | 19 |
| Applicator** | 1 | 1 | 1 | 4 | 4 | 4 | 6 | 6 | 6 | 6 | 5 | 5 |
| Oil Metered, % | 0.547 | 0.721 | 1.120 | 0.563 | 0.730 | 1.115 | 0.484 | 0.624 | 0.786 | 0.997 | 1.066 | 1.089 |
| Oil on Yarn, % | | | | | | | | | | | | |
| Front | 0.810 | 1.025 | 1.375 | 0.800 | 0.770 | 1.010 | 0.745 | 0.800 | 0.920 | 0.910 | 1.115 | 1.015 |
| Rear | 0.835 | 0.945 | 1.035 | 0.800 | 0.925 | 1.190 | — | — | — | — | 0.915 | 1.085 |
| Oil Add On, % | | | | | | | | | | | | |
| Front | 0.485 | 0.700 | 1.050 | 0.420 | 0.445 | 0.685 | 0.420 | 0.475 | 0.595 | 0.585 | 0.865 | 0.765 |
| Rear | 0.515 | 0.625 | 0.715 | 0.480 | 0.605 | 0.870 | — | — | — | — | 0.685 | 0.855 |
| Oil Pick Up Efficiency, % | | | | | | | | | | | | |
| Front | 88.6 | 97.8 | 93.9 | 74.6 | 60.9 | 61.2 | 86.8 | 76.1 | 75.7 | 58.7 | 80.9 | 69.9 |
| Rear | 94.2 | 85.9 | 63.7 | 85.4 | 82.9 | 78.1 | — | — | — | — | 64.5 | 78.8 |
| Average | 91.4 | 91.9 | 78.8 | 80.0 | 71.9 | 69.7 | — | — | — | — | 72.7 | 74.4 |
| Rotation, RPM | — | — | — | — | — | — | — | — | — | — | 60 | 85 |
| End to End Variability | A | A | D | A | B | B | — | — | — | — | B | A |

*Trial terminated due to applicator leakage at low application rates.
**Numbers correspond to drawing figures.

TABLE 3

COMPARISON OF APPLICATORS

| | Example | | | | | | | | | | | | | | | | | |
|---|---|---|---|---|---|---|---|---|---|---|---|---|---|---|---|---|---|---|
| | 20 | 21 | 22 | 23 | 24 | 25 | 26 | 27 | 28 | 29 | 30 | 31 | 32 | 33 | 34 | 35 | 36 | 37 |
| Rotation, RPM | — | — | — | — | — | — | — | — | — | — | — | — | — | — | — | — | — | — |
| Oil Metered, %* | 0.771 | 0.626 | 0.385 | 0.191 | 0.195 | 0.385 | 0.626 | 0.771 | 0.195 | 0.385 | 0.626 | 0.771 | 0.195 | 0.385 | 0.626 | 0.771 | 0.195 | 0.385 |
| Oil on Yarn, % | | | | | | | | | | | | | | | | | | |
| Front | 0.62 | 0.56 | 0.48 | 0.47 | 0.37 | 0.39 | 0.48 | 0.56 | 0.33 | 0.26 | 0.33 | 1.01 | 0.60 | 0.45 | 1.05 | 1.13 | 0.24 | 0.62 |
| Rear | 0.67 | 0.58 | 0.42 | 0.40 | 0.45 | 0.48 | 0.57 | 0.65 | 0.36 | 0.63 | 0.86 | 0.96 | 0.43 | 0.63 | 0.80 | 1.89 | 0.36 | 0.53 |
| Oil Add On, % | | | | | | | | | | | | | | | | | | |
| Front | 0.39 | 0.33 | 0.25 | 0.24 | 0.23 | 0.25 | 0.34 | 0.42 | 0.11 | 0.04 | 0.11 | 0.79 | 0.38 | 0.23 | 0.83 | 0.91 | 0.02 | 0.40 |
| Rear | 0.46 | 0.37 | 0.21 | 0.19 | 0.29 | 0.32 | 0.41 | 0.49 | 0.10 | 0.37 | 0.60 | 0.70 | 0.17 | 0.37 | 0.54 | 1.63 | 0.10 | 0.27 |
| Oil Pick Up Efficiency, % | | | | | | | | | | | | | | | | | | |
| Front | 50.6 | 52.7 | 64.9 | 125.7 | 117.9 | 64.9 | 54.3 | 54.5 | 56.4 | 10.4 | 17.6 | 102.5 | 194.9 | 59.7 | 132.6 | 118.0 | 10.2 | 103.9 |
| Rear | 59.7 | 59.2 | 54.5 | 99.5 | 148.7 | 83.1 | 65.5 | 63.6 | 51.3 | 96.1 | 95.8 | 90.8 | 87.2 | 96.1 | 86.3 | 211.4 | 51.3 | 70.1 |
| Average | 55.2 | 56.0 | 59.7 | 112.6 | 133.3 | 74.0 | 59.9 | 59.1 | 53.9 | 53.3 | 56.7 | 96.7 | 141.1 | 77.9 | 109.5 | 164.7 | 30.8 | 87.0 |
| End to End Variability | A | A | A | A | A | A | A | A | A | D | E | A | C | B | C | — | A | B |

| | Example | | | | | | | | | | | | | | | | | |
|---|---|---|---|---|---|---|---|---|---|---|---|---|---|---|---|---|---|---|
| | 38 | 39 | 40 | 41 | 42 | 43 | 44 | 45 | 46 | 47 | 48 | 49 | 50 | 51 | 52 | 53 | 54 | 55 |
| Rotation, RPM | — | — | 16 | 31 | 45 | 60 | 16 | 31 | 10 | 21 | 31 | 40 | 10 | 21 | 31 | 40 | 10 | 21 |
| Oil Metered, %* | 0.626 | 0.771 | 0.72 | 0.72 | 0.72 | 0.72 | 0.72 | 0.72 | 0.195 | 0.195 | 0.195 | 0.195 | 0.385 | 0.385 | 0.385 | 0.385 | 0.626 | 0.626 |
| Oil on Yarn, % | | | | | | | | | | | | | | | | | | |
| Front | 0.97 | 0.80 | 0.22 | 0.42 | 0.53 | 0.65 | 0.43 | 0.61 | 0.29 | 0.33 | 0.36 | 0.49 | 0.30 | 0.36 | 0.42 | 0.28 | 0.35 | 0.55 |
| Rear | 0.55 | 0.38 | 0.30 | 0.40 | 0.48 | 0.62 | 0.39 | 0.46 | 0.32 | 0.38 | 0.29 | 0.36 | 0.25 | 0.37 | 0.37 | 0.27 | 0.32 | 0.43 |

TABLE 3-continued.

COMPARISON OF APPLICATORS

| | | | | | | | | | | | | | | | | | | |
|---|---|---|---|---|---|---|---|---|---|---|---|---|---|---|---|---|---|---|
| Oil Add On, % | | | | | | | | | | | | | | | | | | |
| Front | 0.75 | 0.58 | — | 0.17 | 0.28 | 0.40 | 0.19 | 0.37 | 0.12 | 0.16 | 0.19 | 0.32 | 0.12 | 0.18 | 0.24 | 0.10 | 0.17 | 0.37 |
| Rear | 0.29 | 0.12 | — | 0.15 | 0.23 | 0.37 | 0.15 | 0.22 | 0.15 | 0.21 | 0.12 | 0.19 | 0.07 | 0.19 | 0.19 | 0.09 | 0.10 | 0.21 |
| Oil Pick Up Efficiency, % | | | | | | | | | | | | | | | | | | |
| Front | 119.8 | 75.2 | — | 23.6 | 38.9 | 55.6 | 26.4 | 51.4 | 61.5 | 82.1 | 97.4 | 164.1 | 31.2 | 46.8 | 62.3 | 26.0 | 27.2 | 59.1 |
| Rear | 46.3 | 15.6 | — | 20.8 | 31.9 | 51.4 | 20.8 | 30.6 | 76.9 | 107.7 | 61.5 | 97.4 | 18.2 | 49.4 | 49.4 | 23.4 | 16.0 | 33.5 |
| Average | 83.1 | 45.4 | — | 22.2 | 35.4 | 53.5 | 23.6 | 41.0 | 69.2 | 94.9 | 79.5 | 130.8 | 24.7 | 48.1 | 55.9 | 24.7 | 21.6 | 46.3 |
| End to End Variability | E | E | — | A | A | A | A | B | A | A | A | B | A | A | A | A | A | B |

| | Example | | | | | |
|---|---|---|---|---|---|---|
| | 56 | 57 | 58 | 59 | 60 | 61 |
| Rotation, RPM | 31 | 40 | 10 | 21 | 31 | 40 |
| Oil Metered, %* | 0.626 | 0.626 | 0.771 | 0.771 | 0.771 | 0.771 |
| Oil on Yarn, % | | | | | | |
| Front | 0.34 | 0.46 | 0.28 | 0.33 | 0.38 | — |
| Rear | 0.40 | 0.51 | 0.16 | 0.32 | 0.36 | 0.41 |
| Oil Add On, % | | | | | | |
| Front | 0.16 | 0.28 | 0.08 | 0.13 | 0.18 | — |
| Rear | 0.18 | 0.29 | — | 0.12 | 0.16 | 0.21 |
| Oil Pick Up Efficiency, % | | | | | | |
| Front | 25.6 | 44.7 | 10.4 | 16.9 | 23.3 | 102.5 |
| Rear | 28.8 | 46.3 | — | 15.6 | 20.8 | 27.2 |
| Average | 27.2 | 45.5 | — | 16.3 | 22.1 | 64.9 |
| End to End Variability | A | A | A | A | A | — |

*Based on weight of yarn.

What is claimed is:

1. Apparatus for applying finish to yarn, comprising: an applicator body, provided with a duct which supplies finish to applicator face, the face comprising the delivery area of the duct and the surface area of two primary arcs, one of the primary arcs being located on either side of the duct and curving in the general direction of yarn travel, the central angle subtended by each of the primary arcs ranging from about 2 to 9 degrees, the edge of each of the primary arcs remote from the duct terminating in a secondary arc which subtends a central angle ranging from about 30 to 60 degrees and having a radius length shorter than that of either of the primary arcs and curving in the direction of yarn travel.

2. The apparatus of claim 1 wherein the radius length of each of the primary arcs ranges from 0.25 to 4.0 inches (0.64 to 10.2 cm).

3. The apparatus of claim 1 wherein the radius length of each of the secondary arcs ranges from 0.005 to 0.025 inch (0.01 to 0.06 cm).

4. The apparatus of claim 1 wherein the applicator body comprises at least two opposing members, a primary and secondary arc on each member, spaced apart with a spacer to form a portion of the finish supply duct.

5. The apparatus of claim 1 wherein the ratio of the length of the duct delivery area to the entire length of the face ranges from 0.10 to 1 to 0.75 to 1.

6. The apparatus of claim 1 wherein the entire applicator face substantially describes a single arc which subtends a central angle ranging from about 10 to 18 degrees.

7. The apparatus of claim 6 wherein the radius length of the single arc ranges from about 0.25 to 4.0 inches (0.64 to 10.2 cm), and wherein the radius length of each of the secondary arcs ranges from about 0.005 to 0.025 inch (0.01 to 0.06 cm).

8. The apparatus of claim 6 wherein the applicator body comprises at least two opposing members spaced apart with a spacer to form a portion of the finish supply duct.

9. The apparatus of claim 6 wherein the ratio of the length of the duct delivery area to the length of the face ranges from 0.10 to 1 to 0.75 to 1.

10. The apparatus of claim 6 wherein the radius length of the single arc ranges from about 0.25 to 4.0 inches (0.64 to 10.2 cm), the radius length of each of the secondary arcs ranges from about 0.005 to 0.025 inch (0.01 to 0.06 cm), the applicator body comprises at least two opposing members spaced apart with a spacer to form a portion of the finish supply duct, and the length of the duct delivery area to the length of the face ranges from 0.10 to 1 to 0.75 to 1.

11. The apparatus of claim 1 in combination with an apparatus for confining a spray of finish issuing from the traveling yarn and the apparatus for applying finish during and subsequent to application of the finish, comprising:

a. a housing to substantially enclose the finish application apparatus and having openings therein for the yarn entrance and exit and for the take-off of excess finish;

b. a plate mounted beneath the finish application apparatus and oriented with respect to the housing such that any finish overflow and drips from the finish application apparatus coming into contact therewith feed by gravity away from the traveling yarn to the take-off opening; and c. at least one baffle disposed between the plate and the take-off opening and oriented with respect to the housing such that any finish overflow and spray coming into contact therewith feed by gravity away from the traveling yarn to the take-off opening, the baffle(s) having a slot therein for passage of the yarn and a raised lip around the slot.

12. The apparatus of claim 11 wherein the finish confining apparatus further comprises a gutter disposed between the plate and the baffle and on the side of the traveling yarn remote from the take-off opening, the gutter being oriented with respect to the housing such that any finish overflow and spray coming into contact therewith feed by gravity away from the traveling yarn to the baffle therebelow.

13. The apparatus of claim 12 wherein the number of baffles is two.

14. The apparatus of claim 13 wherein a second gutter is disposed between the two baffles.

15. Apparatus for confining a spray of finish issuing from a traveling yarn and a finish application device during and subsequent to application of the finish, comprising:

a. a housing to substantially enclose the finish application device and having openings therein for the yarn entrance and exit and for the take-off of excess finish;

b. a plate mounted beneath the finish application device and oriented with respect to the housing such that any finish overflow and drips from the finish application device coming into contact therewith feed by gravity away from the traveling yarn to the take-off opening; and c. at least one baffle disposed between the plate and the take-off opening and oriented with respect to the housing such that any finish overflow and spray coming into contact therewith feed by gravity away from the traveling yarn to the take-off opening, the baffle(s) having a slot therein for passage of the yarn and a raised lip around the slot.

16. The apparatus of claim 15 wherein the number of baffles is two.

17. The apparatus of claim 15 further comprising a gutter disposed between the plate and the baffle and located on the side of the traveling yarn remote from the take-off opening, the gutter being oriented with respect to the housing such that any finish overflow and spray coming into contact therewith feed by gravity away from the traveling yarn to the baffle therebelow.

18. The apparatus of claim 17 wherein the number of baffles is two and wherein a second gutter is disposed between the two baffles.

* * * * *